United States Patent [19]

Fukui et al.

[11] Patent Number: 4,826,572

[45] Date of Patent: May 2, 1989

[54] FRAME WITH A HORIZONTAL SWING PORTION IN A PAPER MAKING MACHINE PRESS SECTION

[75] Inventors: Toshio Fukui; Hiroyoshi Amano; Takayuki Origuchi; Katsuaki Suemune, all of Mihara, Japan

[73] Assignee: Mitsubishi Jukogyo Kabushiki Kaisha, Tokyo, Japan

[21] Appl. No.: 174,446

[22] Filed: Mar. 25, 1988

[51] Int. Cl.[4] ..... D21F 3/02; D21G 9/00

[52] U.S. Cl. ..... 162/272; 100/162 R; 162/273; 162/274; 162/358; 162/360.1

[58] Field of Search ..... 162/199, 200, 272, 273, 162/274, 305, 358, 360.1; 100/155 R, 162 R, 168, 176

[56] References Cited

U.S. PATENT DOCUMENTS

| | | | |
|---|---|---|---|
| 4,192,711 | 3/1980 | Tapio | 162/272 |
| 4,452,668 | 6/1984 | Vallius | 162/199 |
| 4,560,441 | 12/1985 | Kraft et al. | 162/358 |
| 4,608,125 | 8/1986 | Autio | 162/273 |

*Primary Examiner*—Karen Hastings

*Attorney, Agent, or Firm*—Wenderoth, Lind & Ponack

[57] ABSTRACT

In a press-dehydrating section in a paper making machine, for the purpose of facilitating the replacement of a roll by lifting it up and axially moving it with crabs and wires, a portion of a frame of the press-dehydrating section positioned above the roll to be replaced is cut out, and both frame portions facing the cut-out portion are coupled by another frame member that is swingable over a predetermined angle in a horizontal plane. Thus, a dangerous and troublesome operation of rehanging a roll lifted up with crabs and wires by another wire can be dispensed with.

1 Claim, 6 Drawing Sheets

FRAME WITH A HORIZONTAL SWING PORTION IN A PAPER MAKING MACHINE PRESS SECTION

BACKGROUND OF THE INVENTION

1. Field of the Invention

The present invention relates to a frame of a press-dehydrating section in a paper making machine.

2. Description of the Prior Art

First, a general construction of a press-dehydrating section in a paper making machine in the prior art will be described with reference to FIGS. 6 and 7. As shown in these figures, in the press-dehydrating section, a wet paper web (fiber mat) 1, which has been dehydrated to a concentration of about 15–18% in the upstream wet end section and is fed thereto, is further dehydrated by making it successively pass through gaps between a plurality of pairs of press rolls, and is then fed to the downstream heat-dry section. The fiber mat 1 is fed in the downstream section with the aid of a wire 24, that is, an endless net belt which is wound around a plurality of rolls and travels in the direction of the arrow by a roll 25 rotated by a driving device not shown. The web is transferred into the press-dehydrating section by a sucking force of a suction roll rotatably provided at an inlet section of the apparatus. The fiber mat 1 thus transferred in is dehydrated by a pinching action of a press roll 28 and a suction roll 29 in a first press section 27, and is wound around the suction roll 29 to travel to the next press section. Subsequently, predetermined dehydration is effected as passing the web through a second press section 30, a third press section 31 and a fourth press section 32 each having a similar capability, and then the fiber mat 1 is carried out towards the heat-dry section.

In the above-described first to fourth press sections, one of the paired press rolls has its opposite axial ends pivotably supported by a bracket 33, and this bracket 33 is fixedly secured to a swing arm 34 that is supported rotatably about a shaft 35 and adapted to be rocked via a cylinder 18. Accordingly, if the above-mentioned cylinder 18 is actuated via an electromagnetic valve (not shown), then a pressing force can be generated between the paired rolls, but if the cylinder 18 is actuated in the opposite direction, a gap can be formed between the respective rolls. In addition, if the pressure applied to the cylinder 18 is made variable, then the pressing force generated between the rolls can be arbitrarily controlled, so that at the respective press sections and the dehydrating rates can be controlled in a sensitive manner. It is to be noted that in FIG. 7, reference numeral 15 designates endless felts, which are wound around a plurality of rolls and travel in synchronism with the fiber mat 1 by a driving device (not shown), and which have functions of facilitating the desired dehydrating effect and serving as a guide for conveyance.

As described above, in the press-dehydrating section, dehydration of the fiber mat 1 is effected by a strong pressing force between press rolls, and so, it is necessary to cause a considerably strong roll pressure to be generated between the paired rolls. Accordingly, the shaft 35 serving as a fulcrum for the above-described swing arm 34 must have a mechanical strength that is high enough to sufficiently withstand the reaction force against the above-mentioned pressing force, and the frame forming a framework of the apparatus must also have a corresponding mechanical strength. To that end, it is a common practice to at the opposite side edge portions of the top of the apparatus, employ fixed frames (top beams) 2 extending along the direction of travel of the fiber mat 1 so that the apparatus may have a mechanical strength that is high enough to sufficiently withstand the above-mentioned reaction force.

Now the procedure of replacing a press roll will be described. Among the press rolls, there are many varieties of rolls corresponding to desired functions such as rolls 16 and 17 having their surfaces coated with rubber, a suction roll having a hollow inner space and a plurality of air-permeable holes in its circumferential wall, a press roll 8 made of different material, or the like, and hence, during a long period of use, wear and damage arises, which necessitates predetermined repairs. Especially in the case of a rubber roll, in view of its structural characteristic, regrinding of its surface becomes necessary due to wear and the like, and normally it is a common practice to replace the roll every three to six months or more.

And replacement of such a roll is carried out by performing the steps of displacing a roll, positioned right above the roll to be replaced, backwards or forwards in the traveling direction of the fiber mat 1 to a predetermined position, disconnecting a shaft coupling of the roll to be replaced and a press member for a bearing housing 20 (See FIG. 5) pivotably supporting the same roll, hanging the roll with a hoist provided on a ceiling, further transferring it in the axial direction towards the operation side [throughout this specification, the term "operation side" is used to refer to the side faced to a passage of a worker along the traveling direction of the fiber mat (sometimes it is also referred to as "front side"), and the term "drive side" is used to refer to the side opposite to the above-mentioned "operation side" (sometimes it is also referred to as the "rear side")], thereby transferring the roll to a predetermined position.

The process of hanging and carrying a roll out of the device in the prior art is illustrated in FIGS. 5(*a*) to 5(*d*), in which a 2-crab 3-hook type of hoist was used. This type of hoist operates by making use of two sets of hanging units consisting of a hanging unit 37 provided with a single hook 21 and a hanging unit 38 provided with two hooks 36 and 22. At first, wires 23 wound around the outside end portions of a roll shaft are hung from the hooks 21 and 22 at the opposite outer ends and are moved in the axial direction of the roll under the raised condition as shown in FIGS. 5(*a*) and 8(*a*), and are stopped at the position shown in FIG. 8(*b*). Subsequently, a nylon sling 39 wound around the outer circumference of the roll is hung from the hook 36 as shown in FIGS. 5(*b*) and 8(*c*), then the hook 22 positioned at the end of the roll on the side of the drive machine is lowered, and the wire 23 which was hung from the hook 22 is disengaged from the latter as shown in FIG. 5(*c*).

During the above-mentioned steps, the top frame 2 above the roll can be avoided, as the roll is moved in the axial direction to the position shown in FIGS. 5(*c*) and 8(*d*), and subsequently, the roll can be conveyed to a predetermined position. FIG. 5(*d*) illustrates the mode of transfer from the engagement of the roll with a wire 23 shown at (A) to the engagement thereof with a nylon sling 39 shown at (B). It will be obvious that to assemble a new roll, steps in a sequence reverse to those described above are effected. As described above, the replacement of the roll in the prior art difficult, dangerous and time-consuming requiring such steps as rehanging a roll midway during the process of carrying the roll out of the device, in view of interference with a frame structure.

In addition, as an improved frame structure for allowing another method of effecting replacement of a roll in a simple and safe manner by obviating the rehanging step, a frame structure that is advantageous for allowing the replacement of a roll is disclosed in U.S. Pat. No. 4,608,128 (See FIG. 9). However, according to this method, intermediate frame members (connection blocks) 65 are required on both the operation side and the drive side, and moreover, for the purpose of allowing the replacement of a roll, the connection blocks on both sides must be manipulated to be moved. Also, despite the fact that, for the purpose of allowing the replacement of a roll, it is only necessary to ensure a space for allowing a rope to pass therethrough at least only on the operation side, unnecessary work, that is, the dismounting of the block on the drive side and mounting the same is required, and so the procedure for replacement is increased by one step. Moreover, besides the pressing device for a roll, means 64 for revolving a roll is required on both the operation side and the drive side, and so, an increase in the cost of a machine caused by an increase in the number of machine parts is brought about.

During the replacement of a roll in the above-described frame structure of a press-dehydrating apparatus in a paper making machine in the prior art, since a movement of wires 23 is necessary for hanging and carrying a roll out of the frame structure is limited by a frame (top beam) 2 fixedly extending along the direction of travel of a fiber mat at the opposite side edge portions of the top of the above-described press-dehydrating apparatus, inevitably the operation of rehanging a roll with the aid of an additional hook 36 in the middle of carrying the roll out of the frame was effected, as a counter-measure for avoiding the same frame 2. Moreover, there were problems such that the above-described operation of rehanging a roll which is heavy was very dangerous, and that due to this rehanging step, a relatively long time was necessary for the replacement of a roll.

SUMMARY OF THE INVENTION

It is therefore one object of the present invention to provide a novel frame of a press-dehydrating apparatus in a paper making machine in which the above-described problems in the prior art are resolved.

According to one feature of the present invention, there is provided an improved frame of a press-dehydrating apparatus in a paper making machine, in which a desired portion of the frame positioned above a roll which is to be replaced, such as a press roll or the like is recessed, and both portions of said frame facing said cut-out portion are coupled by another frame member that is swingable over a predetermined angle in a horizontal plane.

According to the present invention, during replacement of a roll, since a free space can be formed above the roll to be replaced by revolving the another frame member which is swingable over a predetermined angle, it becomes unnecessary to avoid the interference between a hanging wire and the frame, and so, a roll if hung by the wire can be carried the outside of the apparatus under the initially hung condition.

The above-mentioned and other objects, features and advantages of the present invention will become more apparent by referring to the following description of one preferred embodiment of the invention taken in conjunction with the accompanying drawings.

DETAILED DESCRIPTION OF THE PRFERRED EMBODIMENT

Figure 7:
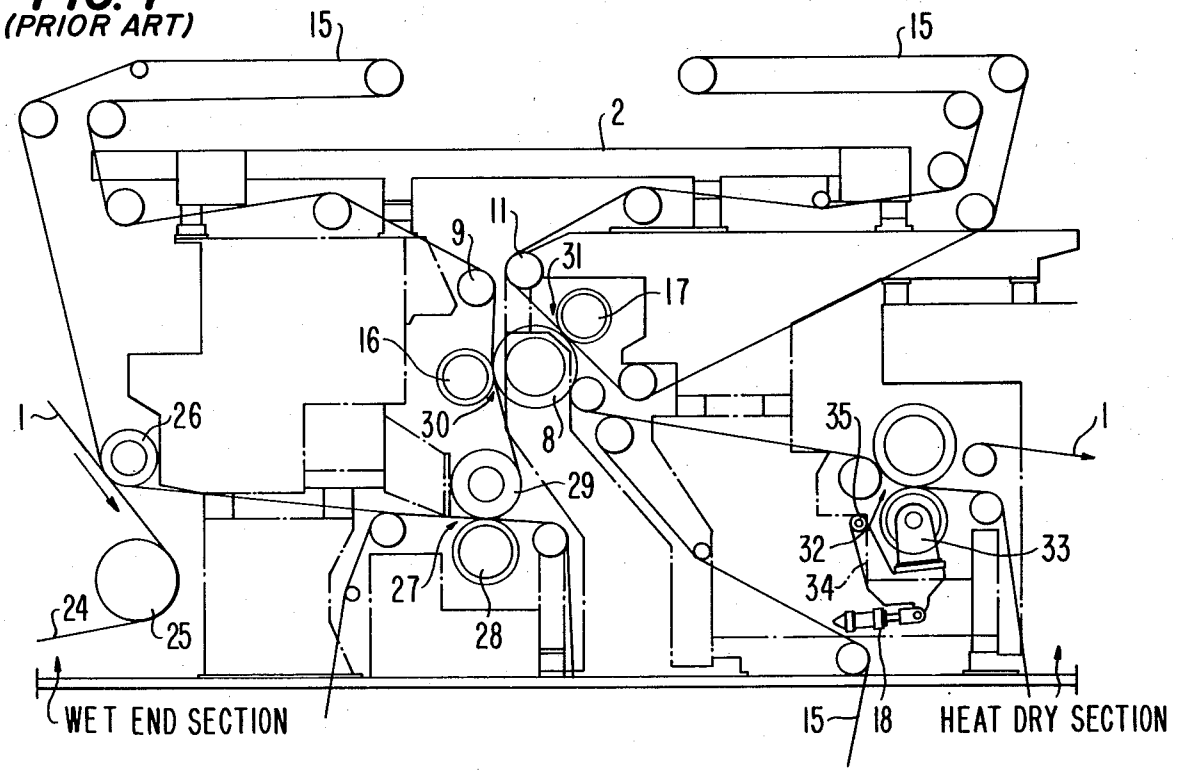
FIG. 7 (PRIOR ART)
FIG. 7 is a side view of a frame structure of a paper making machine in the prior art.
Figure 8B:
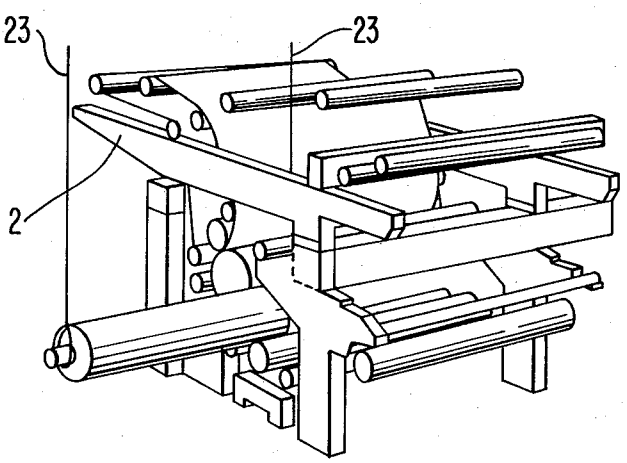
FIG. 8(b) (PRIOR ART)
FIGS. 8(*a*), 8(*b*), 8(*c*) and 8(*d*) are perspective views illustrating successive step in the removal of a roll from a paper making machine in the prior art.
Figure 8D:
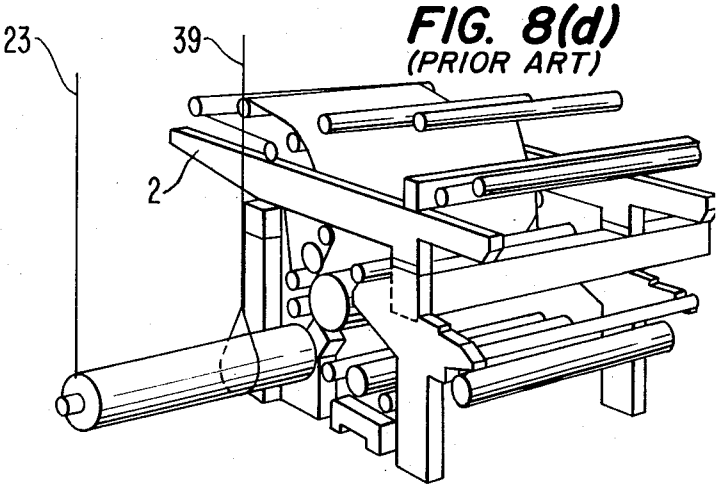
FIG. 8(d) (PRIOR ART)
Figure 8A:
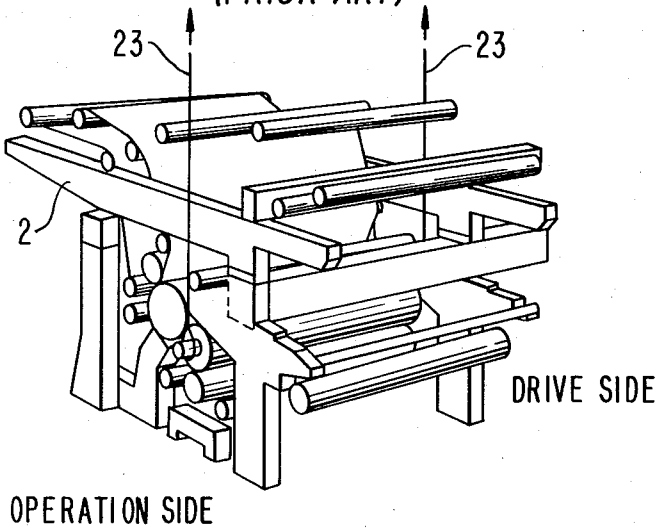
FIG. 8(a) (PRIOR ART)
Figure 8C:
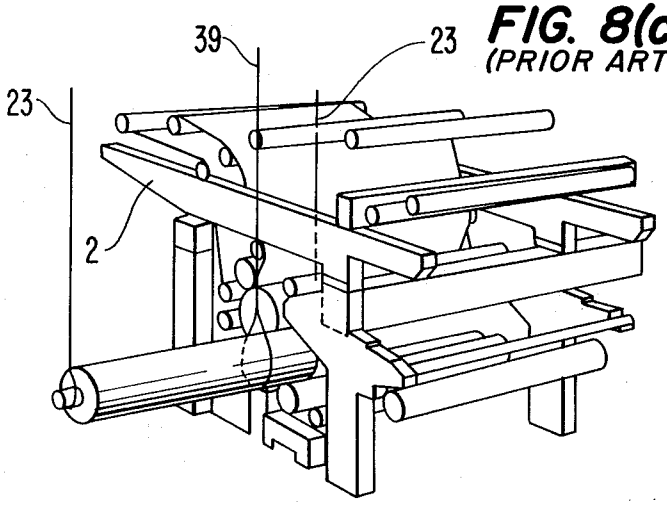
FIG. 8(c) (PRIOR ART)
Figure 9:
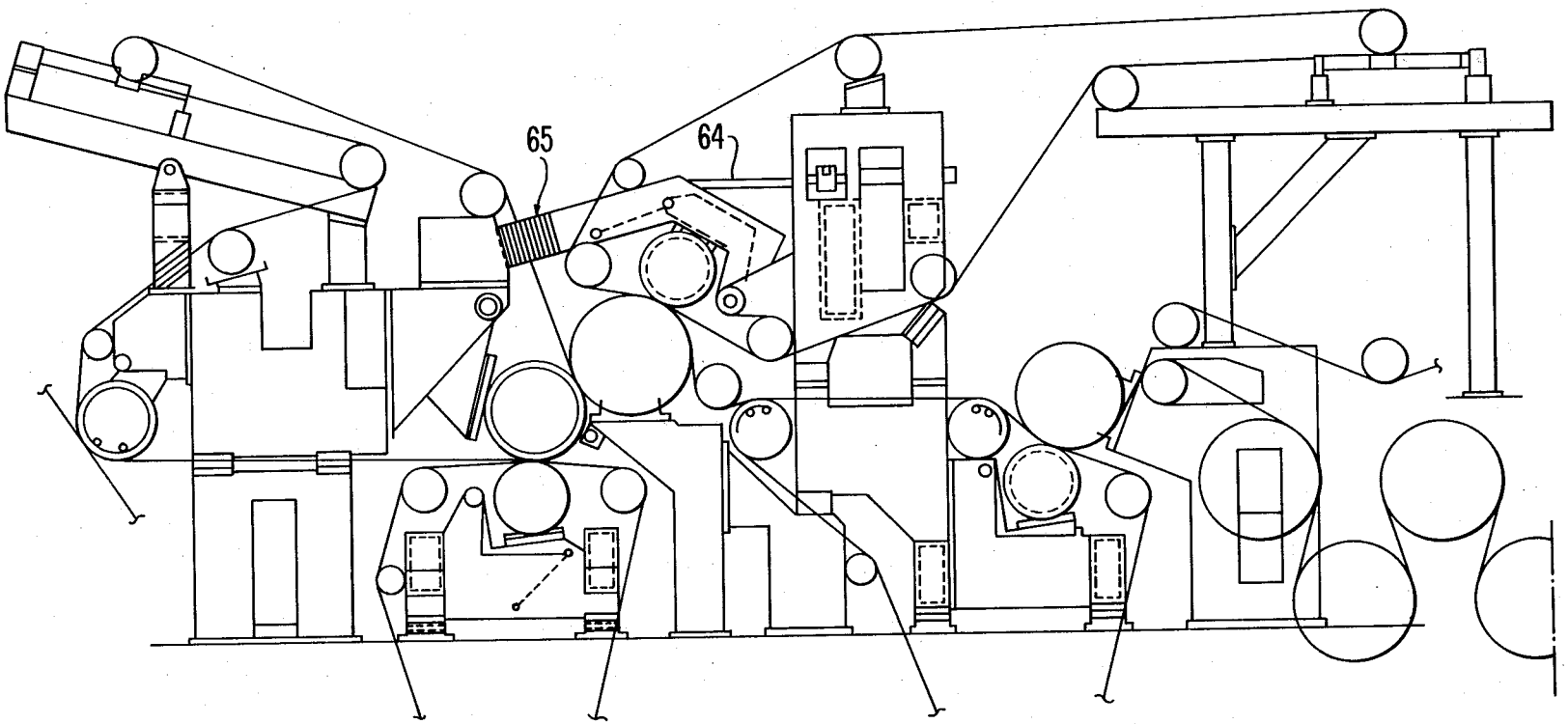
FIG. 9 (PRIOR ART)
FIG. 9 is a side view showing another method of replacing a roll proposed in the prior art.

Now the present invention will be described in greater detail in connection to the preferred embodiment of the invention illustrated in FIGS. 1, 2, 3 and 4. It is to be noted that since the general construction and function of the press-dehydrating apparatus are identical to those of the press-dehydrating apparatus in the prior art shown in FIG. 7, similar component parts are designated by like reference numerals.

Figure 1:
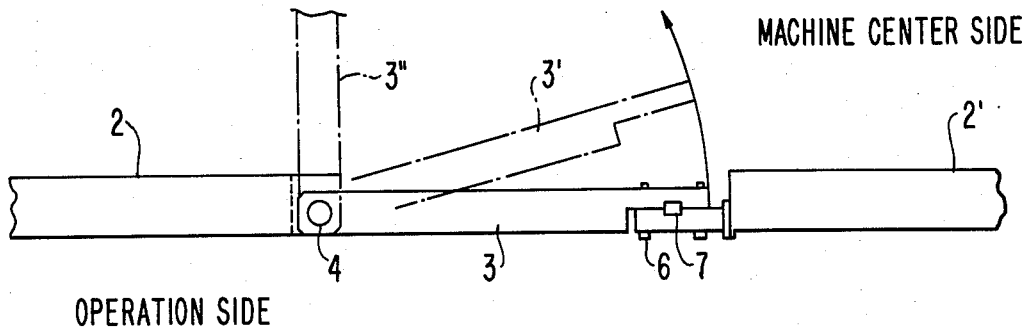
FIG. 1 is a plan view of a frame structure of one part of a press-dehydrating section in a paper making machine according to the present invention.
Figure 2:
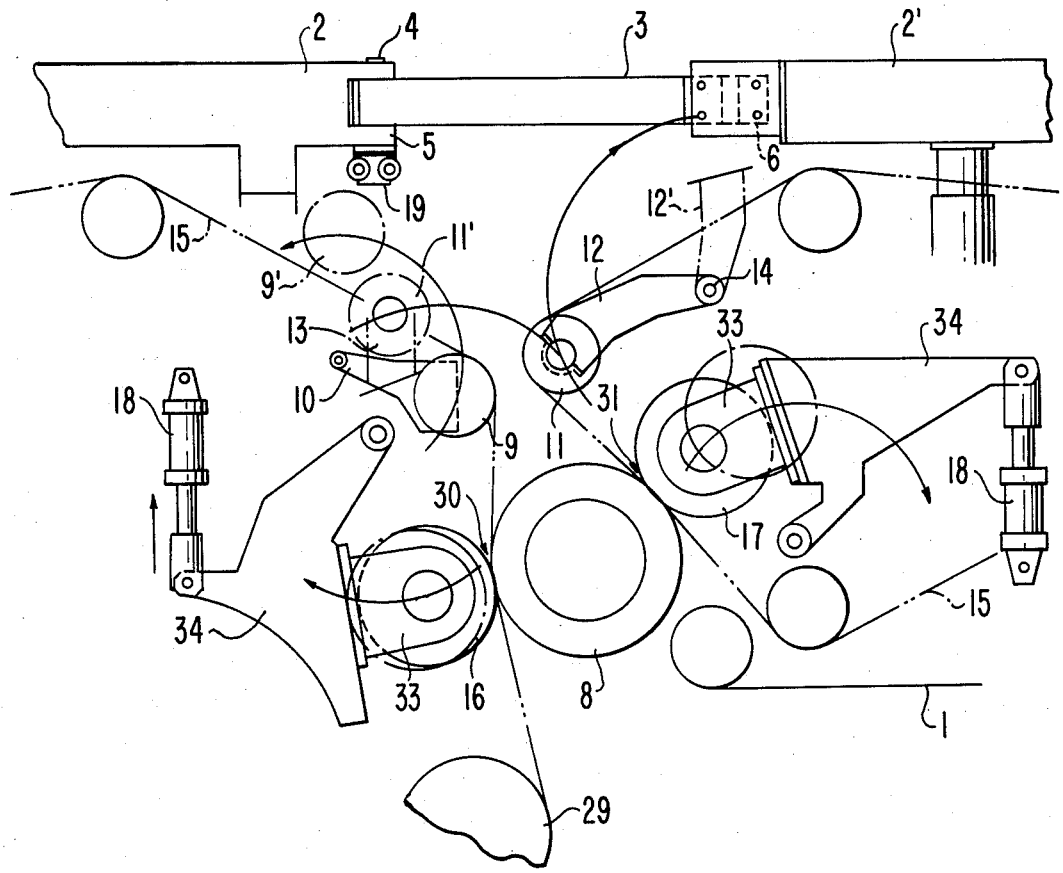
FIG. 2 is a side view of the same frame structure.

As shown in FIG. 1, in the frame (top beam) 2 extending in the direction of travel of a fiber mat 1 along the sides of the top of the press-dehydrating apparatus, a desired length of the frame 2 positioned on the operation side above a press roll or the like is cut out, and the frame portions 2 and 2' facing the cut-out portion is coupled via a separate swing frame 3 that can swing over a predetermined angle in a horizontal plane. More particularly, one end of the swing frame 3 is pivotably supported from a bracket 5 projecting from the left side frame portion 2 via a shaft 4 so that the swing arm 3 can swing about the shaft 4 in a horizontal plane, and the other end of the swing frame 3 is fixedly secured by a bolt 6 to the right side frame portion 2'. It is to be noted that in FIG. 1, reference numeral 7 designates a positioning metal piece, which functions to limit the position of the swing frame 3 and to prevent a deviation in the traveling direction of the fiber mat 1 during the connecting and fastening of the swing frame 3 to the right side frame portion 2'. Thus, during operation of the paper making machine, the left and right frame portions 2 and 2' can be surely held in an integrated state, coupled via the swing frame 3.

Next, the procedure replacing of a roll will be described, by way of example, with respect to a press roll 8. At first, by rotating an arm 10 which pivotably supports a felt roll 9 above and to the left of the press roll 8, the felt roll 9 is moved to a position 9' depicted by a dash-dot line, then a felt roll 11 positioned just above the press roll 8 is separated from an arm 12 and is moved to a position 11' likewise depicted by a dash-dot line and placed on a roll receiver 13 disposed thereat. In addition, the arm 12 having the felt roll 11 dismounted therefrom is rotated about a pivotal shaft 14 and moved upwards to a position 12' depicted by a dash-dot line.

Subsequently, two press rolls 16 and 17 held in contact with the press roll 8 via felt 15 are moved back and forth, respectively, in the traveling direction of the fiber mat 1 by inversely actuating cylinders 18 associated with the respective press rolls, and thus, gaps are formed between the press roll 8 and the respective press rolls 16 and 17. Regarding the releasing operation for the swing frame 3, bolt 6 which fastens the swing frame 3 to the right side frame 2' is extracted, and then the swing frame 3 is rotated about the shaft 4 towards the center of the machine with the aid of driving means 19 as shown by dash-dot lines. It is to be noted that in FIG. 2, by way of example, a torque cylinder is provided as rotational drive means 19 for the swing arm 3. Next, a shaft coupling for the press roll 8 and a press member for a bearing 20 which pivotably supports the press roll 8 are disconnected, then the press roll 8 is hung from hoist provided at the ceiling, the press roll 8 is transferred in the axial direction towards the operation side, and is then carried out of the machine to a predetermined position.

Figure 3:
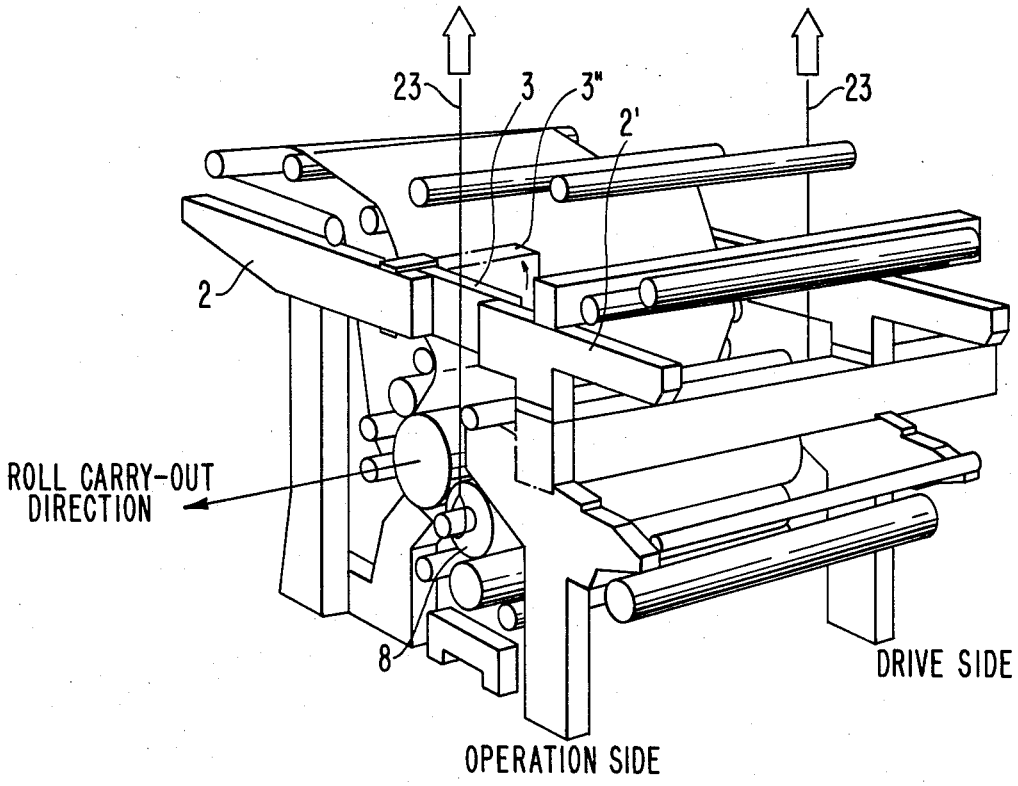
FIG. 3 is a perspective view of the same frame structure.
Figure 4:
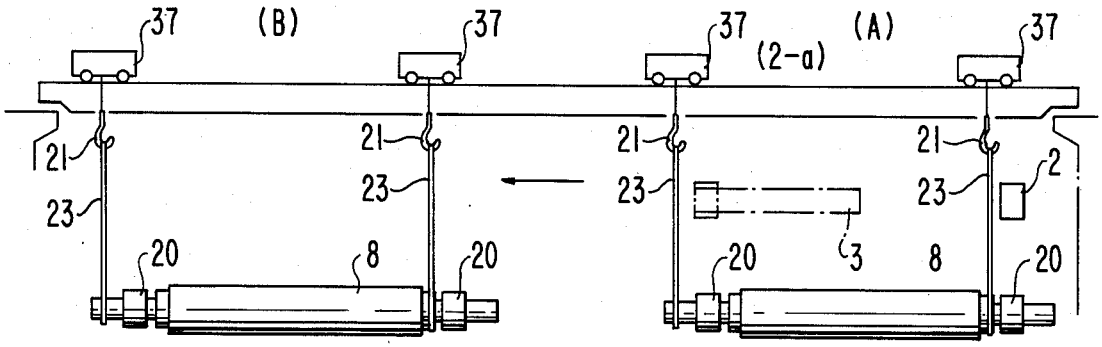
FIG. 4 is a schematic diagram showing a hung state and a carry-out state of a roll in the same frame structure.
Figure 5C:
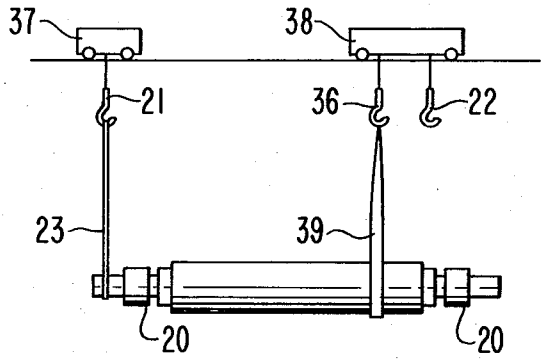
FIG. 5(c) (PRIOR ART)
FIGS. 5(*a*), 5(*b*), 5(*c*) and 5(*d*) are schematic diagrams showing a hung state and a carry-out state of a roll in a frame structure of a paper making machine in the prior art.
Figure 5D:
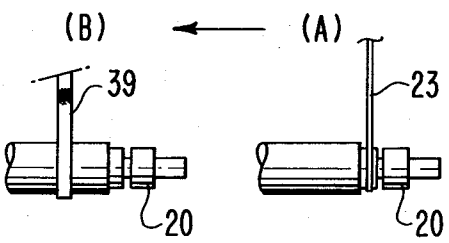
FIG. 5(d) (PRIOR ART)
Figure 5A:
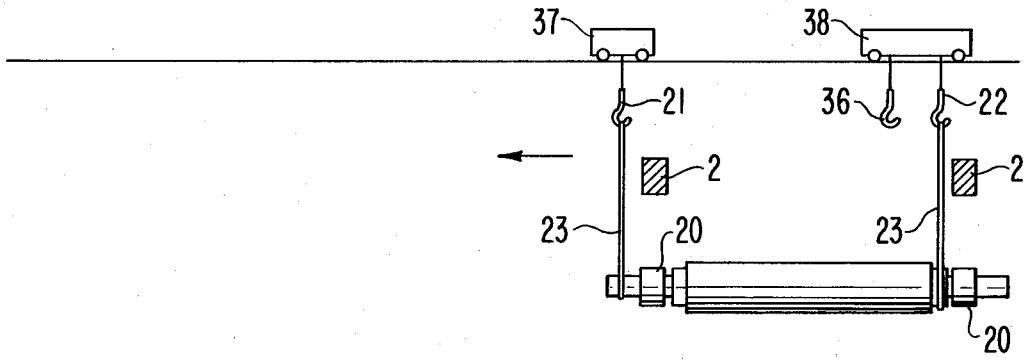
FIG. 5(a) (PRIOR ART)
Figure 5B:
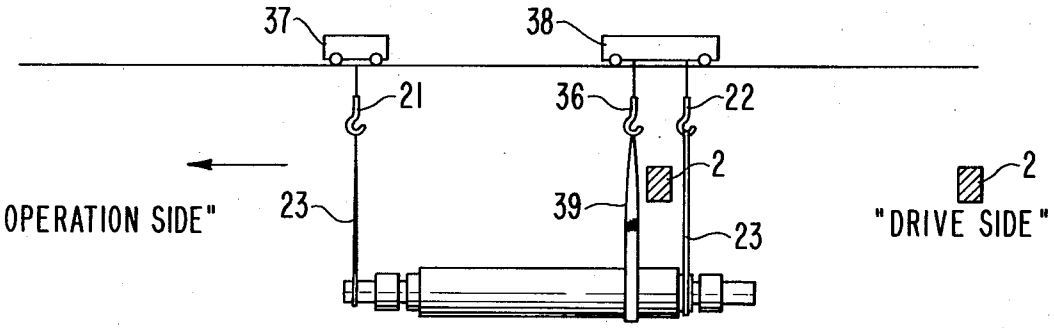
FIG. 5(b) (PRIOR ART)
Figure 6:
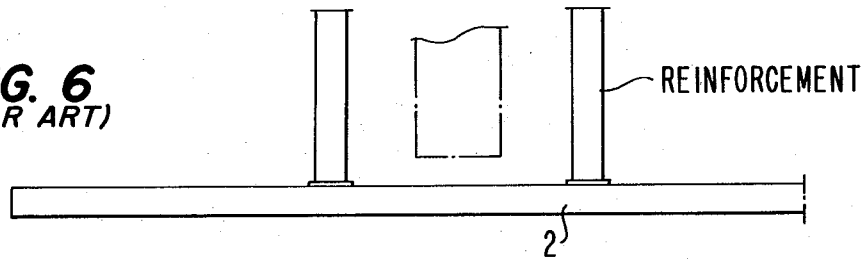
FIG. 6 (PRIOR ART)
FIG. 6 is a plan view of a part of the frame structure of a paper making machine in the prior art.

Now, the operation will be described in greater detail with respect to the case in which a two-crab two-hook type of hoist as shown in FIG. 4 is employed. This hoist functions by the cooperation of two sets of hanging units 37 each provided with a single hook. As shown at (A) in FIG. 4, wires 23 wound around the outer end portions of the shaft of the press roll 8 are hung from a pair of hooks 21, and while the press roll 8 is in a raised state, it is moved to the position shown at (B) in FIG. 4, that is, in the axial direction of the roll towards the operation side. With the frame structure according to the present invention, since a predetermined space can be formed in the path of the hanging wires 23 above the press roll 8 due to the rotational displacement of the swing frame 3, the rehanging work during the middle of the carry-out operation as required in the frame structure of the prior art, is unnecessary. In addition, while carrying in and assembling a roll, it is only necessary to perform the same operations but in a sequence inverse to that described above. Due to the above-described construction and function of the novel frame structure, the time required for replacing a roll is relatively short and relatively high safety can be realized. As to the rotational drive means for the swing frame 3, besides the illustrated torque cylinder, various types of drive systems such as a hydraulic cylinder or the like can be employed as well as a method of manually manipulating the swing frame 3. It is to be noted that a perspective view showing a state of carrying a roll out of the machine is depicted in FIG. 3.

Since the frame in a paper making machine according to the present invention has the above-described structural and functional features, i.e. a part of a frame positioned above a roll that is to be replaced can be displaced to a different location by making it swing, a space can be formed over a desired distance, and hence, in the carrying of the roll out of the machine by hanging it, obstacles in the path of wires from which the roll is hung are eliminated due to this space. Accordingly, the work associated with reengaging hanging wires around a roll as required in the prior art becomes unnecessary, and a roll can be carried to the outside of the apparatus under the condition in which the roll was initially hung. Consequently, the most dangerous rehanging work is obviated, the time necessary for replacing of a roll can be greatly shortened, and so, an improvement in productivity can be achieved.

While a principle of the present invention has been described above in connection with the preferred embodiment of the invention, it is intended that all matter contained in the above description and illustrated in the accompanying drawings be interpreted to be illustrative and not limitative.

What is claimed is:

1. In a papermaking press section containing a replaceable roll rotatably mounted in the section about an axis of rotation and forming at least one press nip with another roll, a frame comprising a top beam extending along one side of the press section and which top beam includes a first top beam portion extending above and located to one side of the replaceable roll with respect to the axis of rotation thereof and a second top beam portion spaced from said first top beam portion and extending above and located to the other side of the replaceable roll with respect to the axis of rotation, a swing frame portion located above the replaceable roll, and means for swingably mounting said swing frame portion to one of said top beam portions between first and second positions disposed in a common horizontal plane extending parallel to the axis of rotation of the replaceable roll, said first position being one at which said swing frame portion extends from said one of said top beam portions toward the other of said top beam portions thereby being located over the replaceable roll, and said second position being one at which said swing frame portion extends away from said other of said top frame portions thereby leaving a space defined between said top beam portions over the replaceable roll, said frame further comprising an integral top beam extending along the other side of the press section from said one side of the replaceable roll to said other side of the replaceable roll, the entire said integral top beam immovably fixed in the press section.

* * * * *